US006047148A

United States Patent [19]

Nagatani et al.

[11] Patent Number: 6,047,148

[45] Date of Patent: Apr. 4, 2000

[54] IMAGE FORMING APPARATUS

[75] Inventors: Kentaro Nagatani, Toyohashi; Hideki Hino, Toyokawa; Kazuo Okunishi, Okazaki; Yoshiaki Takano, Toyohashi, all of Japan

[73] Assignee: Minolta Co., Ltd., Osaka, Japan

[21] Appl. No.: 09/198,526

[22] Filed: Nov. 24, 1998

[30] Foreign Application Priority Data

Nov. 27, 1997 [JP] Japan ..... 9-326578

[51] Int. Cl.[7] ..... G03G 15/16; G03G 15/00

[52] U.S. Cl. ..... 399/66; 399/303; 399/382; 399/401

[58] Field of Search ..... 399/401, 402, 399/396, 388–390, 303, 301, 66, 382; 271/65, 902, 225, 256, 184

[56] References Cited

U.S. PATENT DOCUMENTS

| | | | |
|---|---|---|---|
| 4,853,740 | 8/1989 | Ushio et al. | 399/402 |
| 4,928,128 | 5/1990 | Stemmle | 399/364 |
| 5,095,342 | 3/1992 | Farrell et al. | 399/401 |
| 5,159,395 | 10/1992 | Farrell et al. | 399/401 |
| 5,337,135 | 8/1994 | Malachowski et al. | 399/401 |
| 5,477,250 | 12/1995 | Larson . | |
| 5,703,693 | 12/1997 | Morikawa | 399/364 X |
| 5,797,080 | 8/1998 | Okamoto | 399/391 |
| 5,839,045 | 11/1998 | Wierszewski | 399/382 |

FOREIGN PATENT DOCUMENTS

| | | |
|---|---|---|
| 05002347 | 1/1993 | Japan . |
| 07306550 | 11/1995 | Japan . |

*Primary Examiner*—Matthew S. Smith
*Attorney, Agent, or Firm*—McDermott, Will & Emery

[57] ABSTRACT

An image forming apparatus includes a recording sheet transporting member which transports a recording sheet while holding the recording sheet thereon, the recording sheet transporting member being endless, a recording sheet re-feeding member which inverts the recording sheet and re-feeds the inverted recording sheet to the recording sheet transporting member to thereby allow transferring images on both sides of the recording sheet, and a recording sheet supplying member which supplies the recording sheet from a recording sheet storing portion toward the recording sheet transporting member. The apparatus further includes a controller which controls the recording sheet supplying member so that a supplying of the recording sheet from the recording sheet storing portion is interrupted and then re-tried in a predetermined case. The controller corrects a re-try timing at which the supplying of the recording sheet is re-tried so that the recording sheet being re-tried to be supplied by the recording sheet supplying member does not overlap the inverted recording sheet re-fed by the recording sheet re-feeding member.

11 Claims, 10 Drawing Sheets

IMAGE FORMING APPARATUS

BACKGROUND OF THE INVENTION

1. Field of the Invention

The present invention relates to an image forming apparatus, for example, an electrophotography type, an electrostatic recording type image forming apparatus, or the like, and more particularly, to a color image forming apparatus such as a color copying machine, a color printer, or the similar apparatus, wherein a plurality of image forming members are provided to form a plurality of images, each different in color, on respective image storing members, and then these images are transferred, one on another, in turn, on the same recording sheet held and transported by a recording sheet transporting member.

2. Description of the Related Art

In a conventional image forming apparatus for forming images on both sides of a recording sheet, the recording sheet is transported by an image-transfer belt for transferring an image on one side of the recording sheet and then the recording sheet is reversed and re-fed to the image-transfer belt for forming an image on the other side of the recording sheet. In the conventional image forming apparatus, a re-fed recording sheet and a newly fed recording sheet may be fed alternatively onto the image-transfer belt. In such an apparatus, the overlapping of two recording sheets should be avoided. Japanese Unexamined Laid-open Patent Publication No. H7(1995)-306550 is directed to avoiding such an overlapping of two recording sheets.

On the other hand, in an image forming apparatus which includes an endless image-transfer belt having a seam and which transfers an image to a recording sheet held on the image-transfer belt from a photosensitive drum, if image transferring is performed when the recording sheet is located on the seam, a portion of the image may not be transferred on the recording sheet, resulting in a poor image. In order to solve the problem, an image forming apparatus has been proposed by, for example, Japanese Unexamined Laid-open Patent Publication No. H5(1993)-2347. The image forming apparatus is provided with a seam detector for detecting the seam. The image forming apparatus controls a feeding of the recording sheet so that the recording sheet does not overlap the seam based on the detected result of the seam detector and the size of the recording sheet.

However, in both of the above-mentioned conventional image forming apparatuses, since a supplying of a recording sheet is not re-tried even though the recording sheet is failed to supply or the recording sheet is supplied at an inappropriate timing, a recording sheet which is supplied from a recording supply cassette may overlap the re-fed recording sheet or the seam of the belt.

SUMMARY OF THE INVENTION

It is an object of the present invention to provide an image forming apparatus in which a recording sheet which is to be re-tried to be supplied from a recording sheet storing portion does not overlap a recording sheet which is inverted and is to be re-fed to thereby allow transferring images on both sides thereof.

It is another object of the present invention to provide an image forming apparatus in which a recording sheet which is to be re-tried to be supplied from a recording sheet storing portion does not overlap an inappropriate portion such as a seam of the image-transfer belt.

To attain the above-mentioned purpose, in an image forming apparatus according to the present invention, a re-try timing at which a supplying of a recording sheet is re-tried is corrected so that the recording sheet being re-tried to be supplied does not overlap an inverted recording sheet which is to be re-fed or an inappropriate portion such as a seam of a image-transfer belt.

According to one aspect of the present invention, an image forming apparatus includes a recording sheet transporting member which transports a recording sheet while holding the recording sheet thereon, the recording sheet transporting member being endless, a recording sheet re-feeding member which inverts the recording sheet transported from the recording sheet transporting member and re-feeds the inverted recording sheet to the recording sheet transporting member to thereby allow transferring images on both sides of the recording sheet, a recording sheet supplying member which supplies the recording sheet from a recording sheet storing portion toward the recording sheet transporting member, a controller which controls the recording sheet supplying member so that a supplying of the recording sheet from the recording sheet storing portion is interrupted and then re-tried in a predetermined case, and judge means for judging whether or not a recording sheet which is to be re-tried to be supplied by the recording sheet supplying member would overlap an inverted recording sheet re-fed by the recording sheet re-feeding member.

The controller corrects a re-try timing at which the supplying of the recording sheet is re-tried, based on a judged result of the judge means, so that the recording sheet being re-tried to be supplied by the recording sheet supplying member does not overlap the inverted recording sheet re-fed by the recording sheet re-feeding member.

According to another aspect of the present invention, an image forming apparatus includes a recording sheet transporting member which has a specific portion and transports a recording sheet while holding the recording sheet thereon, the recording sheet transporting member being endless, a recording sheet supplying member which supplies the recording sheet from a recording sheet storing portion toward the recording sheet transporting member, a controller which controls the recording sheet supplying member so that a supplying of the recording sheet from the recording sheet storing portion is interrupted and then re-tried in a predetermined case, and judge means for judging whether or not a recording sheet which is to be re-tried to be supplied by the recording sheet supplying member would overlap the specific portion.

The controller controls a re-try timing at which the supplying of the recording sheet is re-tried based on a judged result of the judge means so that the recording sheet re-tried to be supplied does not overlap the specific portion.

In the apparatus according to the present invention, since the re-try timing is corrected, even though an appropriate timing for supplying a recording sheet is missed, a timing for re-trying the supplying of the recording sheet delays so that the recording sheet which is re-tried to be supplied does not overlap an inverted recording sheet which is re-fed for transferring images on the other side thereof or an appropriate portion of a image-transfer belt.

Other objects and the features will be apparent from the following detailed description of the invention with reference to the attached drawings.

BRIEF DESCRIPTION OF THE INVENTION

The present invention will be more fully described and better understood from the following description, taken with the appended drawings, in which.

DETAILED DESCRIPTION OF THE PREFERRED EMBODIMENTS

Preferred embodiments of the present invention will now be described, in detail, with reference to the accompanying drawings.

Figure 1:
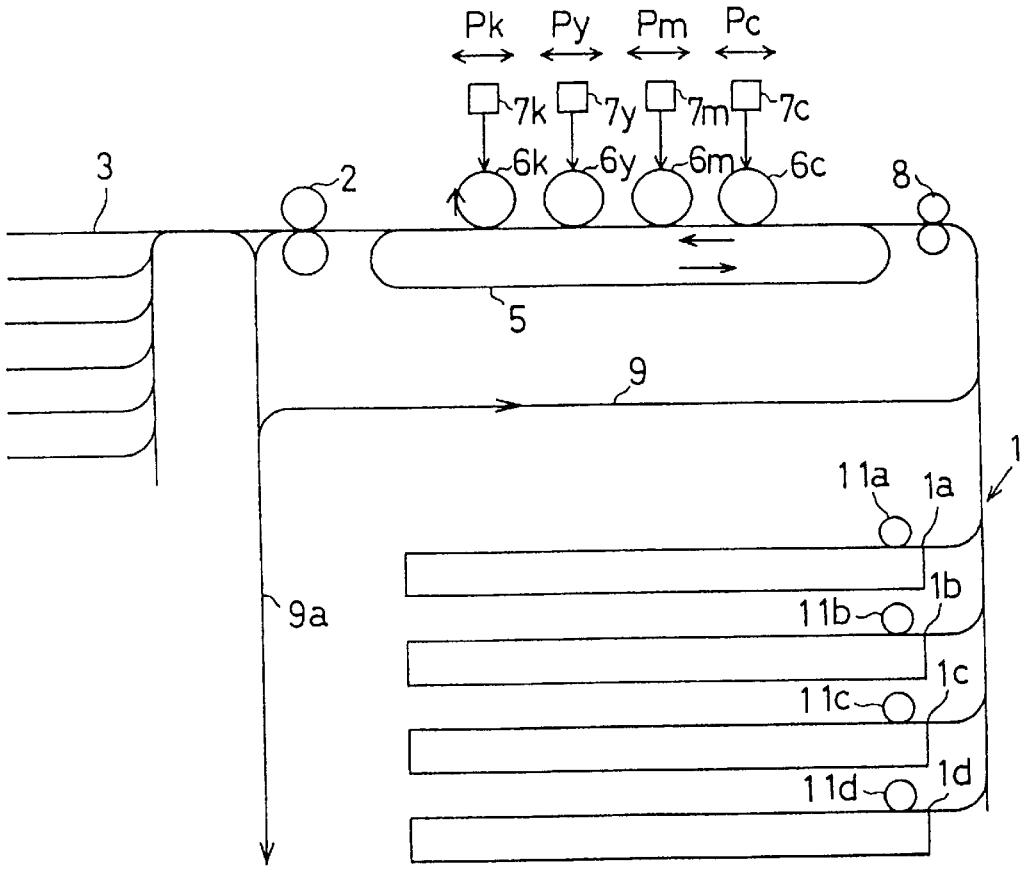
FIG. 1 is a schematic view of a major portion of an image forming unit of a full color image forming apparatus according to an embodiment of the present invention.

FIG. 1 schematically shows a major part of an image forming unit of an electrophotography type full-color copying machine according to one embodiment of the present invention. The present invention can also be applied to various other types of image forming apparatus of electrophotography type, electrostatic recording type, or similar types, other than that of this embodiment. For example, the present invention may be applied to the image forming apparatus disclosed in the U.S. Pat. No. 5,477,250, which employs a non-electrography process.

The image forming apparatus includes four image forming units Pc, Pm, Py, Pk. Disposed below the image forming units is a paper-supply unit 1. At the left side of the image forming units, a fixing device 2 is disposed. At the left side of the fixing device 2, a sorter 3 is disposed. The sorter 3 has functions such as stapling and tray-shifting.

Between the paper-supply unit 1 and the fixing device 2, a circulation path 9 which circularly conveys a paper as a recording sheet is formed. A paper inverting unit 9*a* for inverting and transferring a paper is provided in the circulation path 9 between the fixing device 2 and the paper-supply unit 1. The paper inverting unit 9*a* also serves as a changing device which changes a paper from being introduced into the circulation path 9 for copying the reverse side of the paper into being discharged toward the sorter 3.

At the lower side of a transporting path between the paper-supply unit 1 and the fixing device 2, an endless belt 5 for holding and transporting a paper is provided such that the belt is supported and tensioned by a plurality of rollers (not shown) in a well known manner.

The belt 5 is driven in the direction of the arrows shown in FIG. 1. The belt holds and transports a paper fed from the paper-supply unit 1 to each of the image forming units Pc, Pm, Py, Pk in order.

Each of the image forming units Pc, Pm, Py, Pk, each having substantially the same construction, respectively, includes photosensitive drums 6*c*, 6*m*, 6*y*, 6*k*, each driven to rotate in the direction of the arrow shown in FIG. 1. At around each photosensitive drum, image forming elements (not shown) are disposed.

The above-mentioned image forming elements may be any desired structure. In this embodiment, an electrostatic charger for uniformly charging each photosensitive drum 6*c*, 6*m*, 6*y*, 6*k*, a developing device for developing electrostatic latent images formed on each photosensitive drum, a transferring charger for transferring a developed toner image on a paper, a cleaner for removing toner remaining on the photosensitive drum, are disposed around each photosensitive drum in order in the rotational direction thereof. Image exposing devices 7*c*, 7*m*, 7*y*, 7*k* are provided, respectively, above the photosensitive drums 6*c*, 6*m*, 6*y*, 6*k*.

In the developing devices of the image forming units Pc, Pm, Py, Pk, cyan color toner, yellow color toner, magenta color toner and black color toner are accommodated, respectively.

Each image exposing device 7*c*, 7*m*, 7*y*, 7*k* comprises a semiconductor laser, a polygon mirror, an fθ lense, etc. In the image exposing device, a laser beam, which is modulated in accordance with electric digital image signals, scans in the longitudinal direction on each photosensitive drum 6*c*, 6*m*, 6*y*, 6*k* at location between the electrostatic charger and the developing device to expose the drum surface, thereby forming an electrostatic latent image on each photosensitive drum. An image signal corresponding to a cyan color, a magenta color, a yellow color and a black color component of a color image is input into the respective image exposing device 7*c*, 7*m*, 7*y*, 7*k* of the respective image forming unit Pc, Pm, Py, Pk.

Between the image forming unit Pc and the paper-supply unit 1, a paper adhering member (not shown) is provided so that a paper fed from the paper-supply unit 1 is assuredly and electrically adhered on the belt 5. Between the image forming unit Pk and the fixing device 2, an erasing device (not shown) is provided to erase electrical charge to separate the paper adhering to the belt 5 therefrom.

The belt 5 is made of a resin film sheet having a semiconductor (or conductor) characteristic with opposite ends connected by melting, or the like, to create an endless belt. The belt 5 is endlessly driven at a constant velocity in the direction of the arrow by a driving roller (not shown). A seam of the belt 5 is regarded as an inappropriate portion for an image forming on a paper of a specific type, such as a relative thin paper because the seam portion is different in thickness from the remaining portion, and thus exercises a harmful influence on copying an image onto such a paper from the photosensitive drums 6*c*, 6*m*, 6*y*, 6*k*. Accordingly, as will be mentioned later, when a paper is fed to the belt 5, control is required such that a paper is fed so as not to be located on the seam, or such that only a certain region of a paper is located on the seam during a special situation.

The paper-supply unit 1 comprises a plurality of paper-supply trays (for example, cassette type trays) 1*a*, 1*b*, 1*c*, 1*d* for storing different size papers, paper-supply rollers 11*a*,

11*b*, 11*c*, 11*d* each comprising a paper-supply member for supplying a paper one by one from each paper-supply tray 1*a*, 1*b*, 1*c*, 1*d*, timing rollers 8 as a feeding member for feeding a paper supplied from each paper-supply tray 1*a*, 1*b*, 1*c*, 1*d* onto the belt 5 at a certain time.

Figure 4:
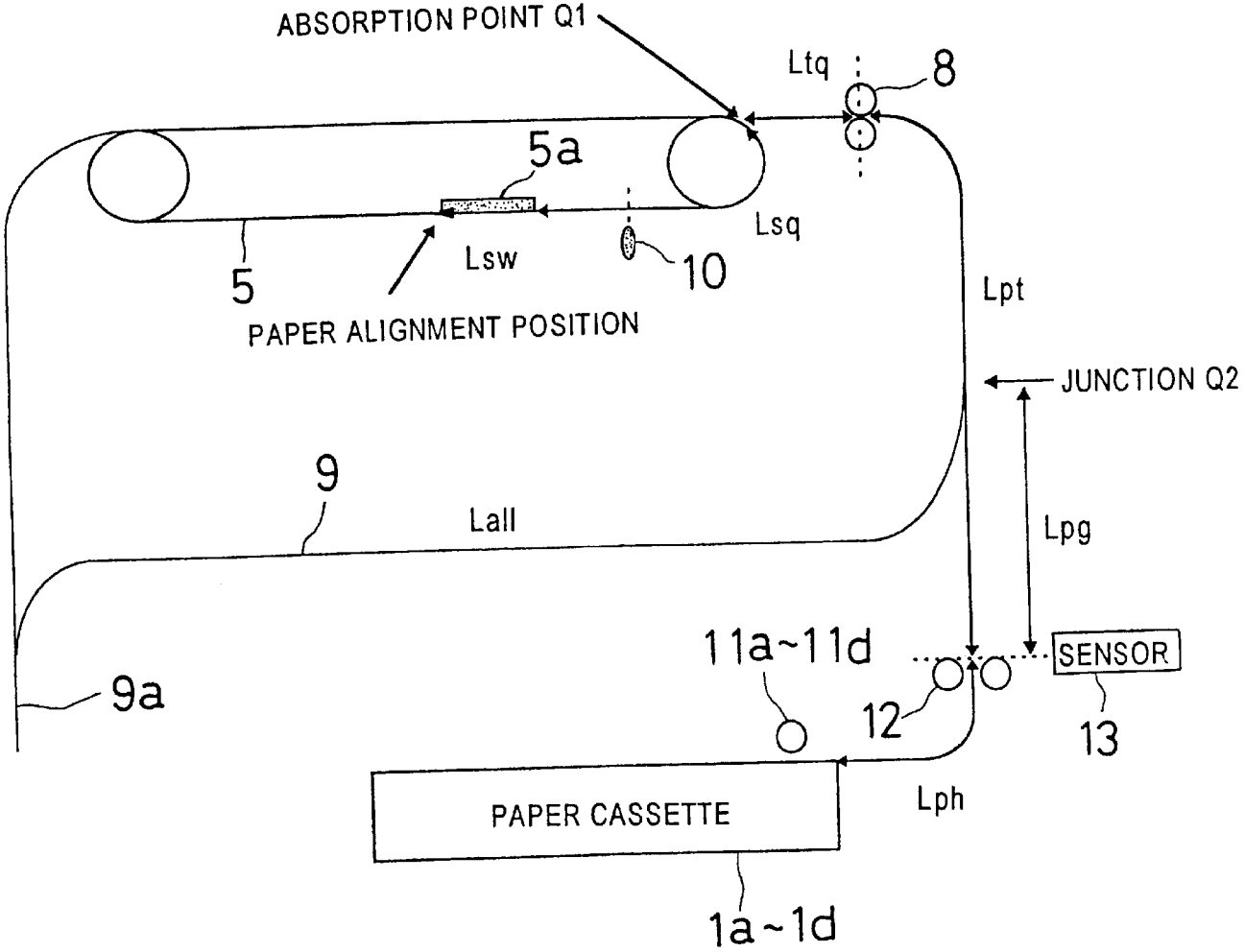
FIG. 4 is a schematic view of timing rollers, an image-transfer belt and therearound according to an embodiment of the present invention.

As shown in FIG. 4, at the upstream portion of the absorption point Q1 in the traveling direction of the belt 5, a seam detector 10 for detecting a seam 5*a* of the belt 5 is provided. A paper which is supplied from one of the paper cassette 1*a*, 1*b*, 1*c*, 1*d* is transported to a junction Q2 of a circulation path 9 by transporting rollers 12, 12 and then transported to the timing rollers 8, 8 by the circulation path 9. At the portion near the transporting rollers 12, 12, a sensor 13 for sensing the paper which is supplied from the paper cassette 1*a*, 1*b*, 1*c*, 1*d* is provided.

In the full color copying machine shown in FIG. 1, when a paper is transported from the timing rollers 8 onto the belt 5 while being guided by a paper transport guide (not shown), the paper is assuredly electrostatically adhered to the belt 5 as a result of the effect of the paper adhering member. With the movement of the belt 5 in the direction of the arrows shown in FIG. 1, a visible image of cyan color (C) is formed on the photosensitive drum 6*c* of the image forming unit Pc, a visible image of magenta color (M) is formed on the photosensitive drum 6*m* of the image forming unit Pm, a visible image of yellow color (Y) is formed on the photosensitive drum 6*y* of the image forming unit Py, and a visible image of black color (K) is formed on the photosensitive drum 6*k* of the image forming unit Pk, each visible image being formed separately. These visible images are transferred, one on another, onto a paper by the transferring charger of each image forming unit Pc, Pm, Py, Pk, in that order, when the paper passes under the photosensitive drum 6*c*, 6*m*, 6*y*, 6*k* of each image forming unit Pc, Pm, Py, Pk, in that order, toward the fixing device 2, in accordance with the movement of the belt 5, resulting in a composite color image. After the paper has passed the image forming unit Pk, the charged electricity of the paper is removed by the erasing device. Then the paper is detached from the belt 5. The paper detached from the belt 5 is discharged to the sorter 3 after the transferred multiple composite images are fixed by the fixing device 2.

In a case where the reverse side of the paper also is to be copied or printed for a two-sided copy, the paper is inverted at the paper inverting unit 9*a* without discharging to the sorter 3 and then transported to the circulation path 9. An image forming onto the reverse side of the paper is performed in the same way as mentioned above, and then the paper is discharged to the sorter 3.

Thus, one series of a copying cycle is completed.

Figure 2:
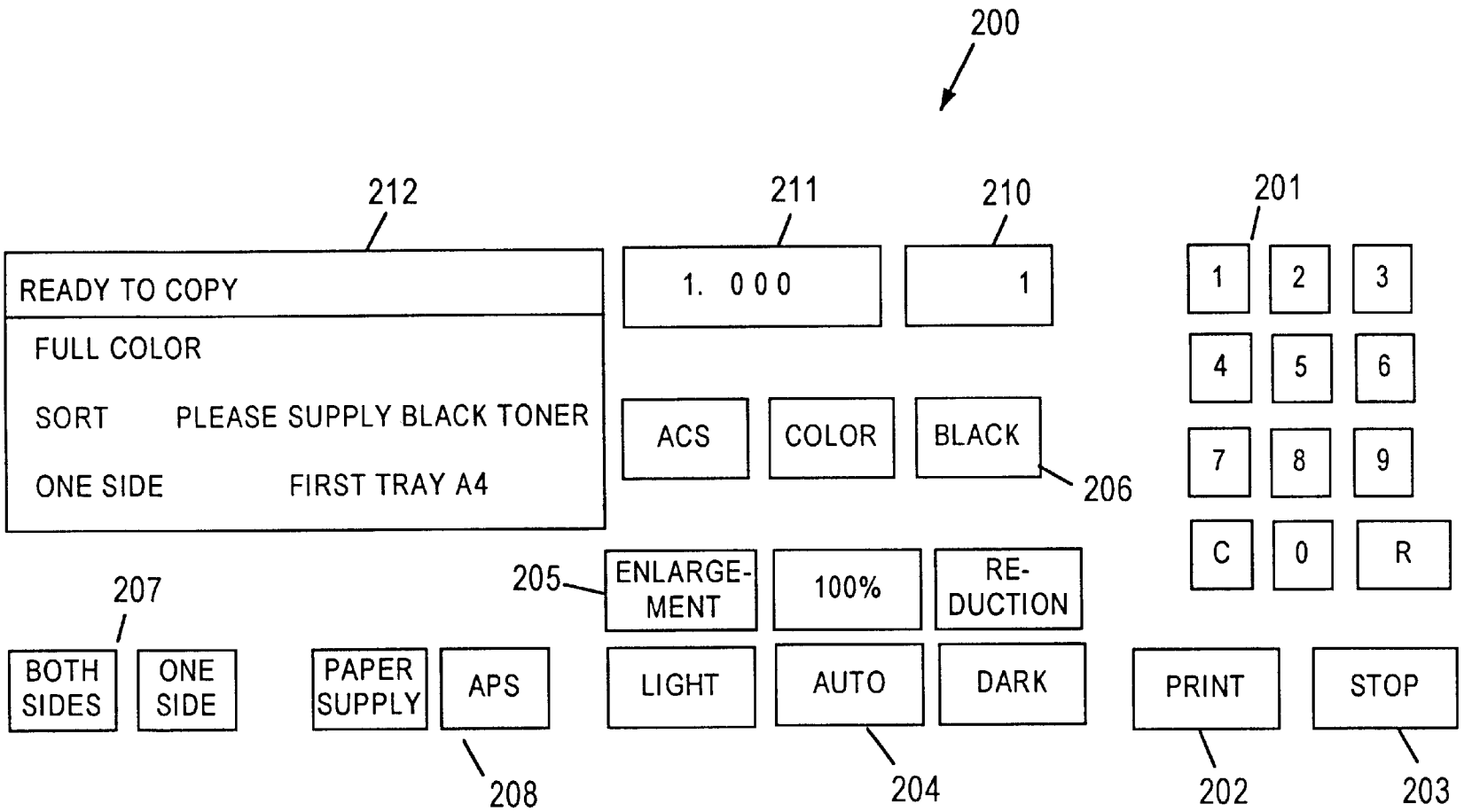
FIG. 2 is a plan view showing a portion of an operation panel according to an embodiment of the present invention.

FIG. 2 shows a part of the operation panel 200 of the full color copying machine shown in FIG. 1. This operation panel 200 enables the user to select a certain copy mode from various copy modes, start copying and recognize the set copy mode and the condition of the apparatus from the display.

A copy number setting portion 201 includes a plurality of keys for setting number of copies to be made and clearing the set number.

A key 202 marked as 'PRINT' is used to start copying. A key marked as 'STOP' is used to stop a copying operation. Darkness setting keys 204 are used to adjust the darkness of the image to be copied. Reduce/enlarge rate setting keys 205 are used to set a reduce/enlarge rate of the image to be copied. Color mode selecting keys 206 are used to set whether the image to be copied is printed in full color or only in black.

Copy side selection keys 207 are used to set whether the image to be copied is printed on one side of a paper or on both sides thereof. Tray select keys 208 are used to select one of four paper-supply trays.

A copy number display portion 210 displays number of copies to be made before the copy operation and number of remaining copies during the copy operation. A reduce/enlarge rate display portion 211 displays the set rate. A liquid crystal display portion 212 is a multi-purpose display portion which displays the set copy mode, the status of the apparatus and various information other than the information of the number of papers or the reduce/enlarge rate.

Figure 3:
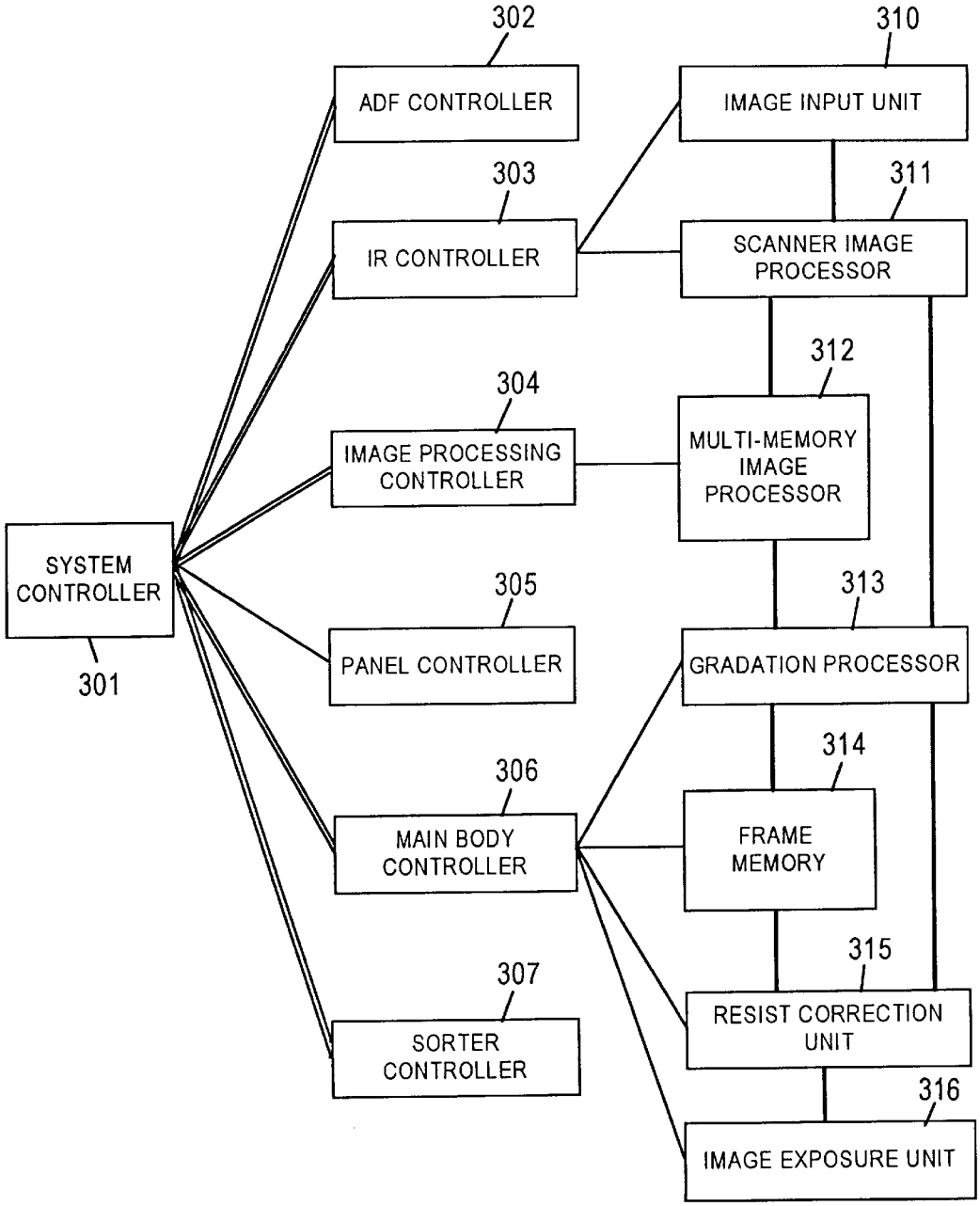
FIG. 3 is a block diagram showing a whole control of the apparatus according to an embodiment of the present invention.

FIG. 3 is a block diagram showing an overall control of a full color copying machine, such as the one shown in FIGS. 1 and 2.

The full color copying machine includes an image reader (IR) for reading an image information of a document as a function of a copying machine, an automatic document feeder (ADF) for automatically feeding a document one by one to an image reading portion of the image reader, in addition to the image forming main portion and the panel portion described in detail with FIGS. 1 and 2. However, the construction of the machine is not limited to the above.

A system controller 301 is a control portion which controls the whole copying machine.

An ADF controller 302 is a control portion which controls the automatic document feeder such that documents are fed one by one to the image reading portion of the image reader and are discharged to a document discharge portion after the completion of the reading of the images.

An IR controller 303 is a control portion for controlling the scanning velocity and position of a scanner for reading an image of a document.

An image processing controller 304 is a control portion which operates a multi-memory image processor 312 depending on a copy sequence or a copy mode. Concretely, the image forming processing controller 304 controls the recording of an image signal processed by a scanner image processor 311 for every one page of the documents. Further, the image processor controller 304 controls the selecting of an image signal of the document stored for every one page in the order depending on a copy sequence, etc. and the sending of stored the image signal to a gradation processor 313. Furthermore, the image processing controller 304 controls a rotation of an image by 90 degrees or 180 degrees depending on a copy mode, etc.

A panel controller 305 is a control portion which processes and displays key inputs of the operation panel 200 as described with FIG. 2.

A main body controller 306 is a control portion which controls the transportation of papers, the belt 5, the photosensitive drums 6*c*, 6*m*, 6*y*, 6*k*, the image forming elements disposed around the drums, the fixing device 2, etc., described in connection with FIG. 1. A more detailed explanation will be given later.

A sorter controller 307 is a control portion which controls the discharge of the papers in the sorter 3, the movement of bins, the position of the shift tray and the stapling operation.

An image input unit 310 includes a sensor comprising CCD and the like for reading an image of a document, a circuit which digitalizes the signal from the sensor. In this embodiment, each component of the color image C, M, Y and K is processed at the same time.

The scanner image processor 311 includes a circuit for reducing/enlarging, shifting, erasing the digitalized image signal depending on a copy mode, etc.

The multi-memory image processor 312 includes a memory for storing image information and a circuit for rotating or reducing/enlarging an image.

The gradation processor 313 includes a circuit which converts the tone data, for example, from eight tones to three tones, corresponding to a circuit.

A frame memory 314 includes a circuit which temporarily saves image signals of a plurality of pages when copying both sides and outputs an image signal of a required page at a required time.

A resist correction unit 315 includes a circuit which delays the image signals corresponding to each C, M, Y and K composition of the color image by a time corresponding to a timing gap of the paper passing below the image forming units Pc, Pm, Py, Pk in the order. By this circuit, the image signal of each C, M, Y and K component can be processed at the same time between the image input unit 310 and the gradation processor 313 or the frame memory 314.

The image exposure unit 316 corresponds to the reference numerals 7*c*, 7*m*, 7*y*, 7*k* shown in FIG. 1, and comprises a circuit which forms an electrostatic latent image of each C, M, Y and K component on the respective photosensitive drums 6*c*, 6*m*, 6*y*, 6*k* in response to a corresponding image signal.

Figure 5:
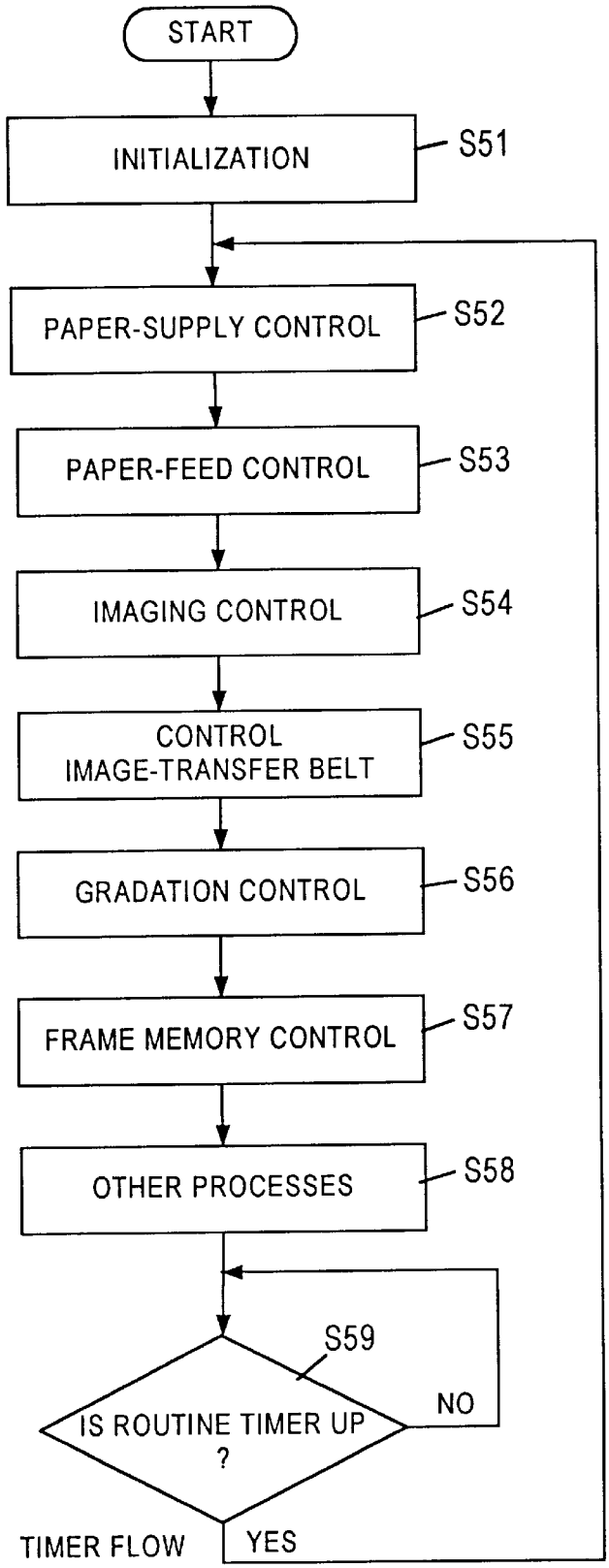
FIG. 5 is a flowchart showing a main routine process according to an embodiment of the present invention.

FIG. 5 is a flowchart showing the operation flow of the main body controller 306. When the power source is turned on to activate the CPU of the main body controller 306 (Step S51), prescribed initialization is performed for the CPU, the memory, I/O and other units.

In Step S52, a paper-supply control is performed in response to a request for supplying a paper from a corresponding paper-supply cassette to the paper-transportation path. The details of which will be described later.

In Step S53, the transported papers are fed onto the belt 5 to form and fix images on the paper, and the papers bearing images on their front sides are inverted at the paper inverting unit 9*a* and again fed to the belt 5. This step will be described in more detail later.

Then, the electronic imaging process is controlled in Step S54. Various sub-processes including charging, exposure, development, transfer, and discharging are controlled as necessary.

In Step S55, the motion of the belt 5 is controlled. At the same time, the position of the seam 5*a* is detected, and necessary information is generated. Some of the information relates to the prohibition and permission of paper supply, and the prohibition and permission of rotation of the timing rollers 8. The information may also include the paper sizes, the size of the original, and other imaging conditions.

In the subsequent steps (that is, gradation control (Step S56) and frame memory control (Step S57), necessary commands and parameters are supplied to the gradation processor 313 and the frame memory 314 which perform the associated operations.

Other processes are also performed in Step S58, including communication with other CPUs, detection of abnormal operations, input/output processes from the I/O port, and operations for external image formation devices which are not directly related with the present invention.

Finally, in Step S59, it is determined whether the routine timer is up. The routine timer is re-set every time the operation flow from step S52 (paper supply) to step S58 (other processes) has been completed.

There are several types of paper-supply mechanisms employed in an image recording apparatus using a image-transfer belt.

(1) A paper-supply mechanism for one-side imaging. Papers are successively supplied onto the belt 5 so as to avoid the seam 5*a*.

(2) A paper-feed mechanism for both-side imaging. A prescribed number of papers which can be accommodated in the circulation path 9 are supplied from the paper cassette at the same time. After images have been recorded on all of the papers currently accommodated in the circulation path, a new set of papers are supplied to the belt 5, avoiding the seam 5*a*.

(3) An alternation-type paper-feed mechanism for both-side imaging. A new paper is supplied from the paper cassette so that the new paper will be inserted between two papers which have been circulated in the circulation path, each of which already bears an image on one side. Again, papers are supplied so as to avoid the seam 5*a* of the belt 5.

The system controller 301 selects the most-appropriate paper-supply mode. According to the selection by the system controller 301, the main-body controller 306 controls the paper-supply timing. In this sequence, the system controller 301 supplies a paper-supply request to the main-body controller 306 for each paper.

Figure 6:
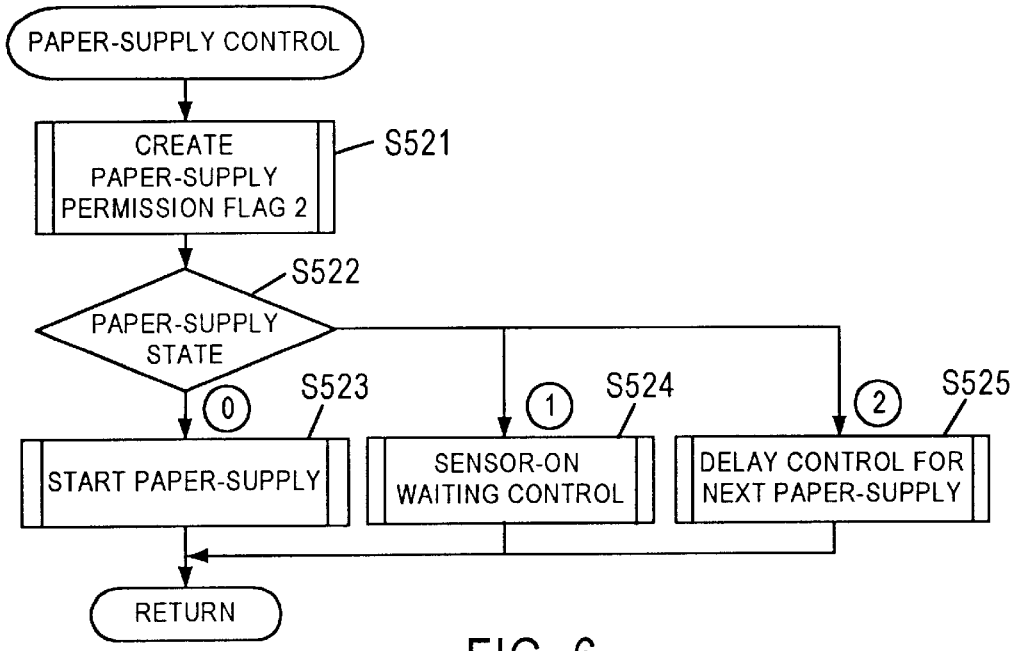
FIG. 6 is a flowchart showing a recording sheet supplying process according to an embodiment of the present invention.

FIG. 6 is a flowchart showing the detailed steps of the paper-supply control (Step S52 shown in FIG. 5). First, a paper-supply permission flag 2 is created in Step S521, and the paper state is determined based on the counter value of the state counter in Step S522. There are three states, which are successively performed according to the counter value of the state counter. If the counter value is zero, the process proceeds to Step S523, in which a paper-supply action is started after the paper-supply request and the paper-supply activation conditions are confirmed. Then, the paper-feed operation is performed until the sensor (FIG. 4) is turned on in Step S524. This step corresponds to the state counter value as 1.

Then, in Step S525 which corresponds to the state counter value of 2, a predetermined time interval is taken before the next paper-supply in order to maintain the paper interval constant.

Figure 7:
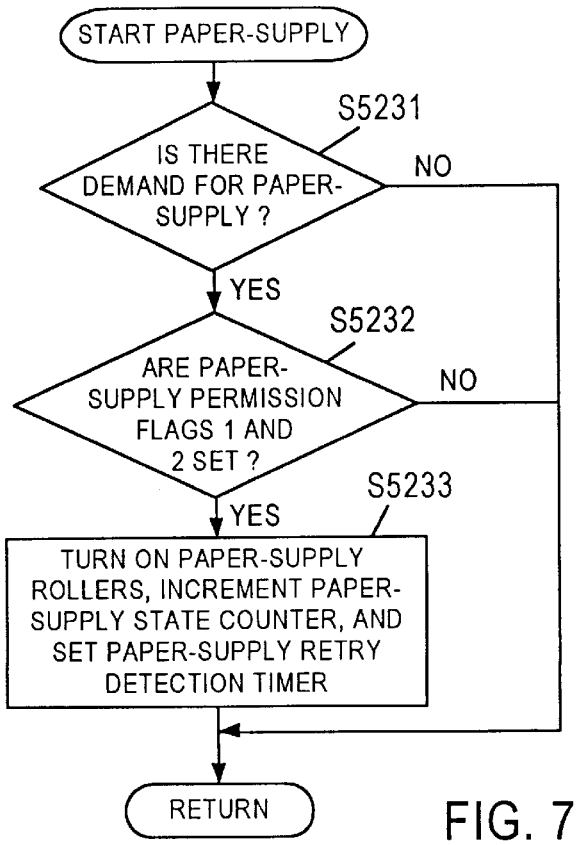
FIG. 7 is a flowchart showing a recording sheet supplying start process according to an embodiment of the present invention.

FIG. 7 shows detailed steps of the activation of paper-supply (Step S523 shown in FIG. 6).

First, it is determined, based on paper-supply permission flags 1 and 2, if a paper-supply operation should be performed (Step S5231 and Step S5232).

If there is a request for paper-supply in Step S5231, then, it is determined if both the paper-supply permission flags 1 and 2 are set in Step S5232. The paper-supply permission flag 1 indicates that if a paper is supplied at the current point of time, the paper will not overlap the seam 5*a* of the transfer belt 5. The paper-supply permission flag 2 indicated that if a paper is supplied at the current point of time, the paper will not collide with the paper which has been circulated in the circulation path for recording an image on the back face. Because a new paper is not supplied from the cassette unless both permission flags 1 and 2 are set, the new paper is supplied to the transfer belt 5 at an appropriate timing even if the paper-supply operation is delayed due to a re-try action.

Thus, even if a re-try action is taken during the paper supply operation, the image quality can be maintained by referring to the two permission flags prior to supplying a new paper. This is an advantage over the prior art.

The determination of these two flags 1 and 2 will be described in more detail later.

Figure 8:
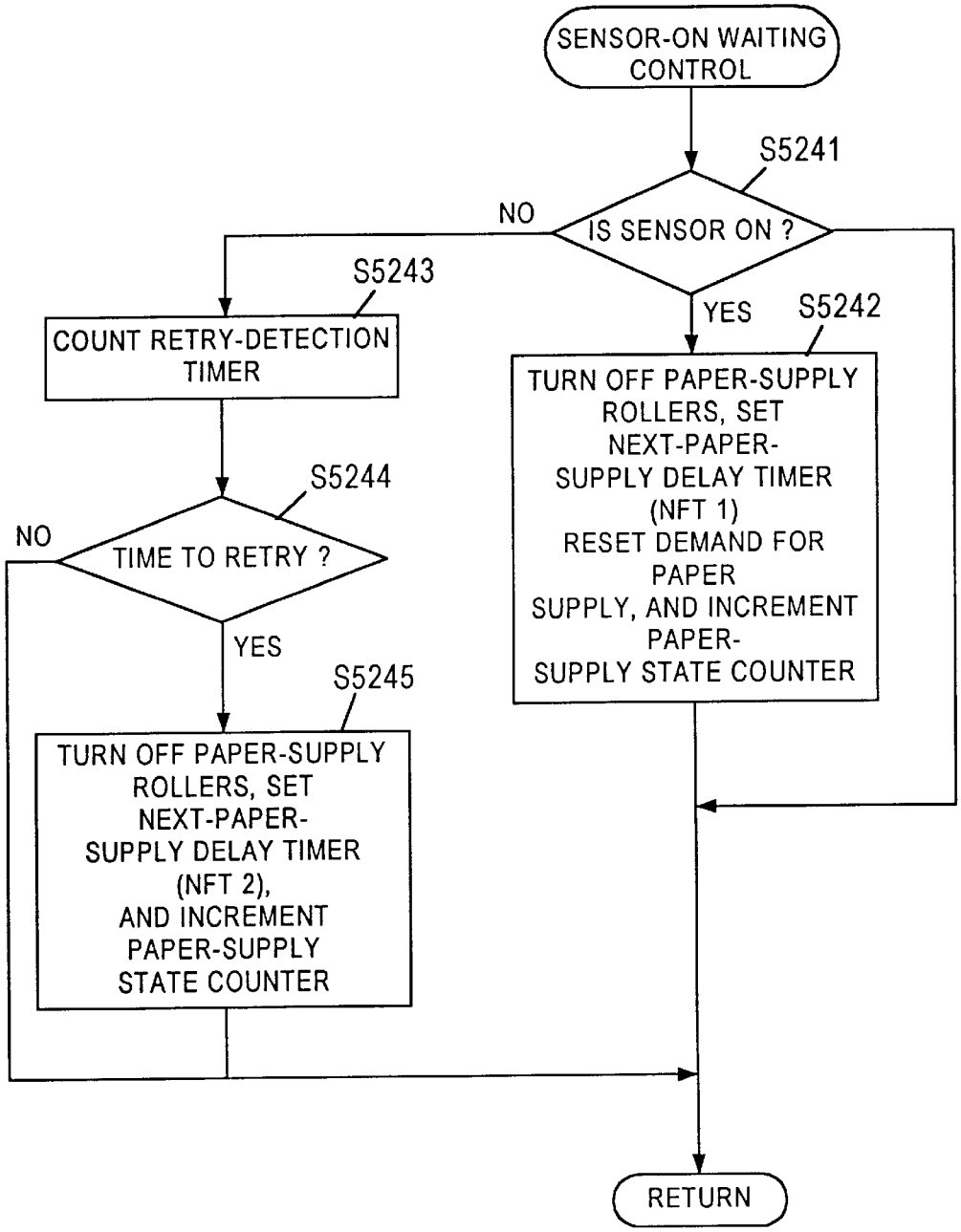
FIG. 8 is a flowchart showing a sensor-on-waiting process according to an embodiment of the present invention.

Next, FIG. 8 shows the detailed steps of the sensor-on waiting control operation (Step S524 in FIG. 6).

First, it is determined if the sensor 13 is in the ON state (Step S5241). If the sensor is not in the ON state, the re-try detection timer is started (Step S5243). When a predetermined time is counted, it is regarded that a new paper has not been supplied yet, and a re-try action is taken in Step S5244 and Step S5245. In Step S5245, a next-paper-supply delay timer (NFT 2) counts a time for pausing the paper-supply rollers 11*a*—11*d* during the re-try operation.

If the sensor is in the ON state in Step S5241, a new paper is supplied in Step S5242.

In Step S5242, a next-paper-supply delay timer (NFT 1) is set. This timer is used to keep a correct paper interval between the current paper and the next paper. The paper interval is determined based on the paper size, the imaging mode (one-side or both-side photocopy), the paper-supply mode (alternating-type paper supply or collective supply), etc. The control operation for determining the paper interval is not directly related to the present invention and, therefore, the explanation for it will be omitted.

Figure 9:
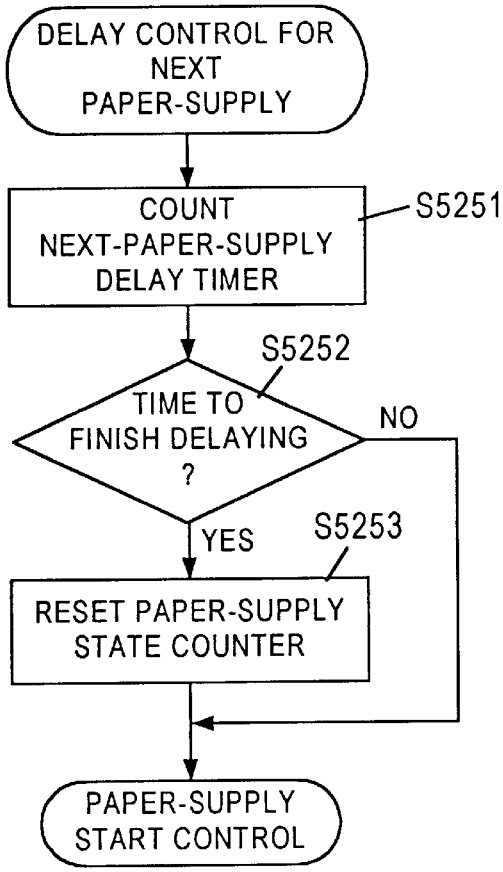
FIG. 9 is a flowchart showing a next recording sheet supplying start delay process according to an embodiment of the present invention.

FIG. 9 shows the detailed steps of the delay control for the next paper-supply (Step S525 in FIG. 6). First, the next-paper-supply delay timer is counted in Step S5251. If the timer counts up in the determination of Step S5252, the state counter is reset to zero (i.e., the start of the paper-supply control) in Step S5253.

Figure 10:
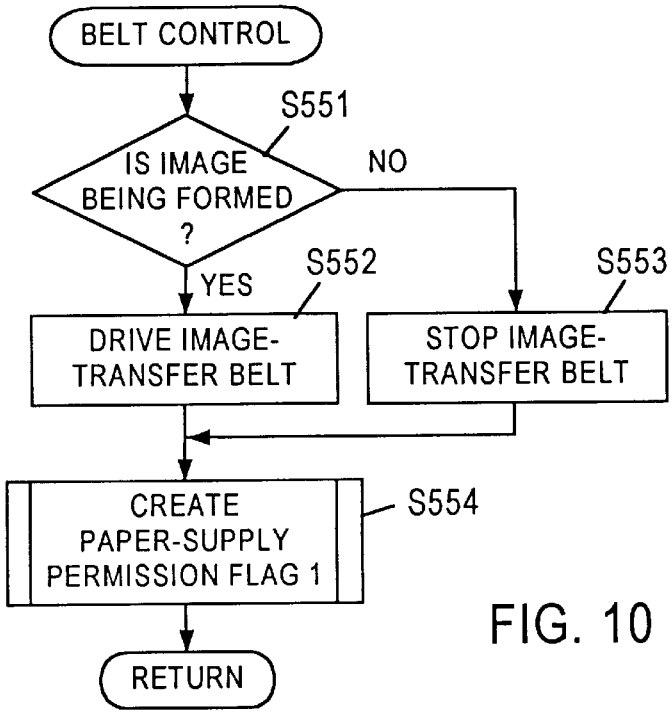
FIG. 10 is a flowchart showing a image-transfer belt control process according to an embodiment of the present invention.

FIG. 10 shows the detailed steps of the belt control (Step S55) shown in FIG. 5. In this process, driving and stopping of the transfer belt 5 is controlled, and a paper-supply permission flag 1 is created according to the position of the seam 5*a*. First, it is determined if an image is being recorded on a paper in Step S551. If an image is being recorded (i.e., YES in the determination of Step S551), the transfer belt 5 is driven. If an image is not being formed (i.e., NO in the determination of Step S551), the transfer belt 5 is stopped in Step S553. Then, a paper-supply permission flag 1 is created in Step S554.

Figure 11:
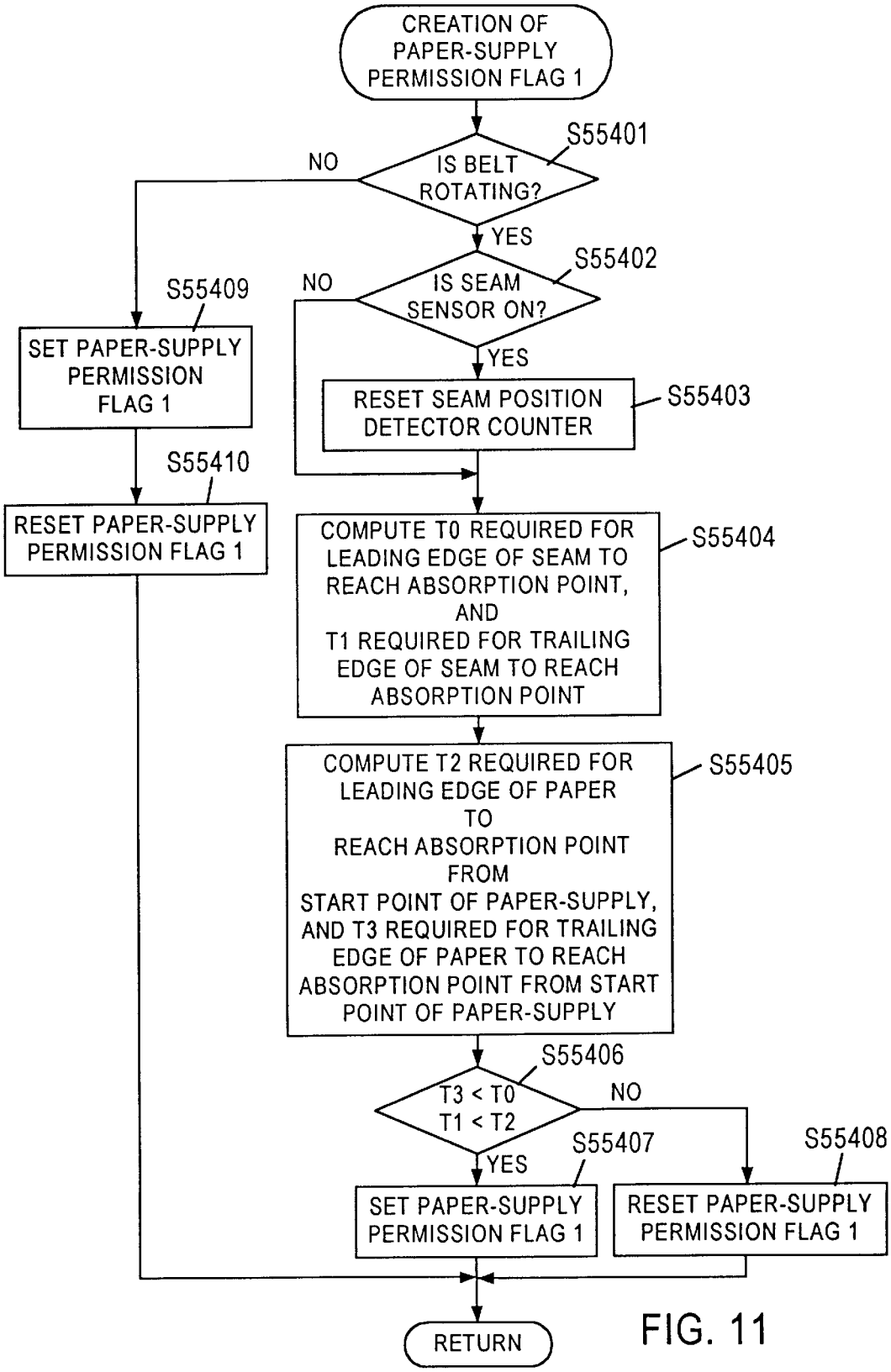
FIG. 11 is a flowchart showing a process for forming a recording sheet permission flag 1.

FIG. 11 shows the detailed steps of the creation of the paper-supply permission flag 1. This process is mainly directed to setting and resetting the paper-supply permission flag 1.

The paper-supply permission flag 1 is set only if it is determined that if a paper is supplied from a selected cassette at the time of determination, the paper will not overlap the seam 5*a* of the transfer belt 5. This determination is applied to both the regular paper feeding and the re-try operation.

First, in Step S55401, it is determined if the transfer belt 5 is rotating. If the belt 5 is at rest (i.e., NO in the determination of Step S55401), the paper-supply permission flag 1 is reset in Step S55409 and Step S55410) because a paper can not be fed.

If the transfer belt 5 is rotating (i.e., YES in the determination of Step S55401), it is determined if the seam detection sensor 10 is in the ON state in Step S55402. If the seam detection sensor 10 is in the ON state, the seam-position detection counter is reset in Step S55403. The seam-position detection counter counts time during the rotation of the transfer belt 5, and the distance from the seam detection sensor 10 to the current position of the seam 5*a* can be calculated from the counter value. In Step S55404, time T0 required for the leading edge of the seam 5*a* to reach the absorption point Q1, and time T1 required for the trailing edge of the seam 5*a* to reach the absorption point Q1 are calculated based on the counter value of the seam-position detection counter.

Then, in Step S55405, time T2 and time T3 required for the leading edge and the trailing edge of a paper to reach the absorption point Q1 are calculated based on the assumption that the paper is supplied from the paper cassette at the current point of time.

If both T1<T2 and T3<T0 are satisfied in Step S55406, it is regarded that the paper will not overlap the seam 5*a,* and the paper-supply permission flag 1 is set in Step S55407. Otherwise, the paper-supply permission flag 1 is reset in Step S55408.

More explanation will be made on times T0 through T3. As shown in FIG. 4, several parameters are denoted by the follow abbreviation:

Lsq: distance from the leading edge of the seam 5*a* to the absorption point Q1

Lsw: width of the seam 5*a* in the direction of traveling of the belt 5

Lph: distance from one of the paper cassettes 1*a* through 1*d* to the longitudinal feed sensor 13

Lpt: distance from the longitudinal feed sensor 13 to the timing rollers 8

Lpg: distance from the longitudinal feed sensor 13 to the junction Q2

Ltq: distance from the timing rollers 8 to the absorption point Q1

$Lp_{size}$: length of the paper in the paper-feed direction

Spd: paper feed speed

Lr: the amount of loop formed before the timing rollers 8

Then, T0 through T4 are represented by the following equations.

$$T0=(Lsq)/Spd$$

$$T1=(Lsq+Lsw)/Spd$$

$$T2=(Lph+Lpt+Lr+Ltq)/Spd-Lph/Spd$$

$$T3=(Lph+Lpt+Ltq+Lp_{size})/Spd$$

Among these equations, T2 and T3 include a term Lph/Spd. The reason for it will be explained below.

The leading edge of the paper may occasionally project from the cassette port due to a re-try action or a pull by the previous paper. In this case, if the leading edge of the paper reaches the longitudinal feed rollers 13, the paper is fed to the paper-feed path. Accordingly, the maximum amount of projection from the cassette is Lph.

T2 is determined on the assumption that the amount of projection of the-leading edge of the paper is maximum, and T3 is determined on the assumption that the amount of projection is minimum.

Figure 12:
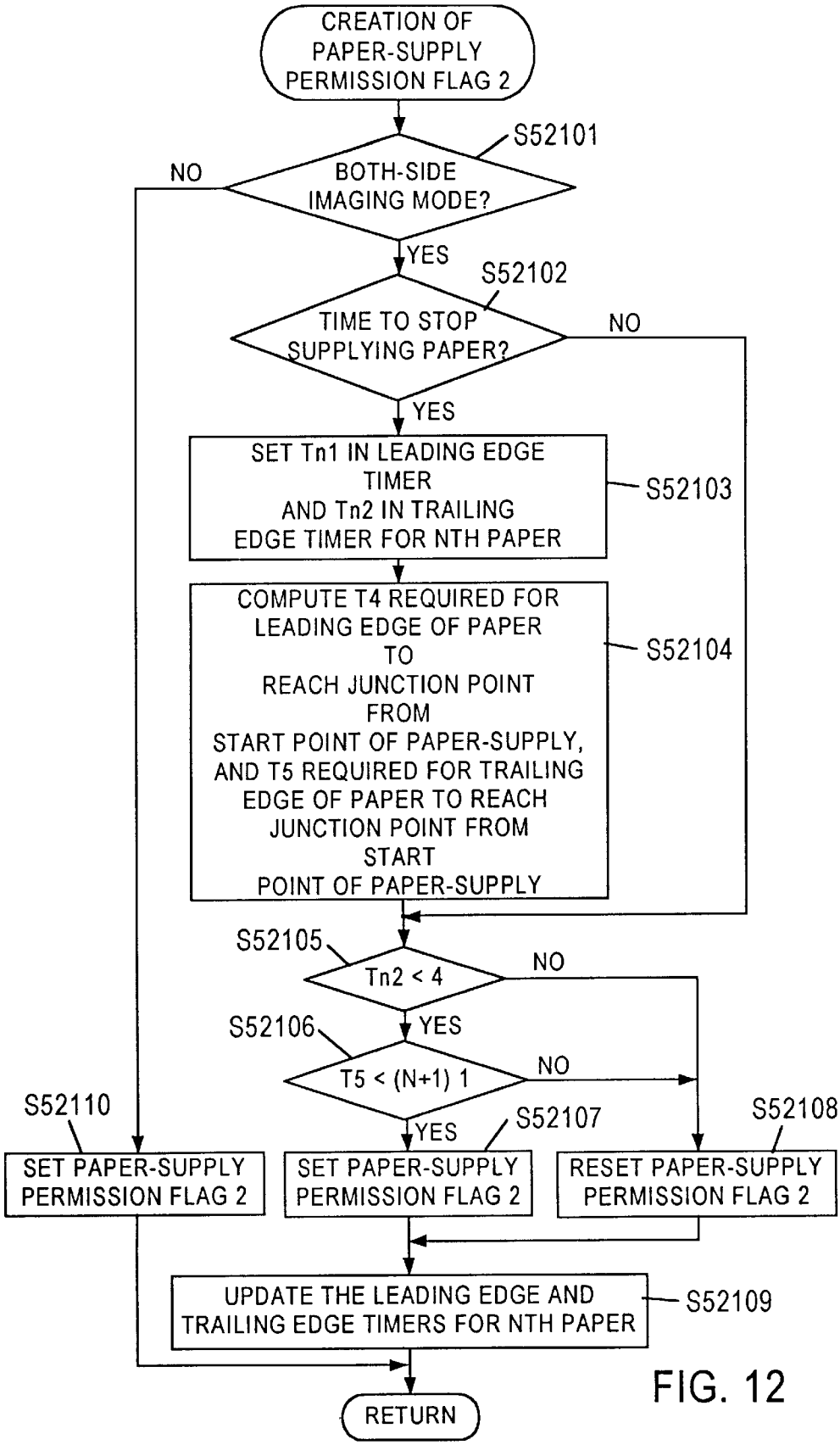
FIG. 12 is a flowchart showing a process for forming a recording sheet permission flag 2.

FIG. 12 shows the detailed steps of the creation of the paper-feed permission flag 2 (Step S521) shown in FIG. 6.

As has been described earlier, the paper-feed permission flag 2 is created if it is determined that a new paper will not collide with or overlap the paper which has been circulated and inverted for image formation on the back face if the new paper is supplied from the cassette at the time of the determination. This determination also applies to the re-try action.

In order to predict the collision or overlap with the circulated paper, it is necessary to know when the circulated paper reaches the junction Q2 in the paper-feed path. To achieve this, timers Tn1 and Tn2 are provided in the circulation path 9. The values of the timers Tn1 and Tn2 indicate the current positions of the leading edge and the trailing edge of the paper which is being circulated in the circulation path 9. (n is a natural number which indicates the paper number.)

First, it is determined if the both-side imaging mode is selected in Step S52101. If the both-side imaging mode is not selected (i.e., NO in the determination of Step S52101), the paper-supply permission flag 2 is set (Step S52110).

If the both-side imaging mode is selected (i.e., YES in Step S52101), then it is determined if it is time to finish supplying a new paper in Step S52102. If it is time to finish the paper-supply action (YES in the determination of Step S52102), Tn1 and Tn2 which correspond to the current paper are set in Step S52103.

If the paper-supply action is terminated when the leading edge of the paper reaches the longitudinal feed sensor 13, the timer values Tn1 and Tn2 are represented as follows.

$$Tn1=(Lpt+Lr+L_{total})/Spd$$

$$Tn2=(Lpt+L_{total}+Lp_{size})/Spd$$

where $L_{total}$ is the total length of the circulation path 9.

Then, times T4 and T5 required for the leading edge and the trailing edge of a new paper to reach the junction Q2 are calculated from the equations below, on the assumption that the paper is supplied from the cassette at the current point of time (Step S50214).

$$T4=(Lpg)/Spd$$

$$T5=(Lph+Lpg+Lp_{size})/Spd$$

For T4, Lph/Spd is not calculated because a re-try action and a pull by the previous paper are taken into account. Then, it is determined if Tn2<T4 and Td<T(n+1)1 are satisfied for all n in Step S52105 and Step S52106. If both relationships are satisfied (YES in Step S52105 and Step S52106), the paper-supply permission flag 2 is set in Step S52107. If at least one relationship is not satisfied in Step S52105 and Step S52106, the paper-supply permission flag 2 is reset in Step S52108.

Finally, the timers Tn1 and Tn2 for the leading edge and the trailing edge of the $n^{th}$ paper are incremented in Step S52109, and the process returns.

Because the paper-supply action is taken only if the paper-supply permission flag 2 is set, a new paper is prevented from colliding with the circulated paper even if the paper-supply timing is slightly changed due to a re-try action.

In the embodiment described above, the seam 5*a* of the belt 5 is used as an example of undesirable factor which adversely affect the final image quality. However, the present invention can be applied to other undesirable factors to be avoided.

Especially, re-try timing correction means can correct the paper-supply timing for a re-try action so that a newly supplied recording medium (i.e., paper) will not collide with other medium, or overlap the seam of the recording medium carrying means (i.e., transfer-belt), even if the original paper-supply timing is missed for some reasons. As a result, an image recording apparatus can reproduce an image always at a correct paper-supply timing in both the normal operation and the re-try operation, while the image quality is maintained high by supplying a paper so as to avoid the seam of the belt.

This application claims priority to Japanese Patent Application No. H9(1997)-326578 filed on Nov. 27, 1997, the disclosure of which is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. An image forming apparatus, comprising:

a recording sheet transporting member which transports a recording sheet while holding the recording sheet thereon, said recording sheet transporting member being endless;

a recording sheet re-feeding member which inverts the recording sheet transported from said recording sheet transporting member and re-feeds the inverted recording sheet to said recording sheet transporting member to thereby allow transferring images on both sides of the recording sheet;

a recording sheet supplying member which supplies the recording sheet from a recording sheet storing portion toward said recording sheet transporting member;

a controller which controls said recording sheet supplying member so that a supplying of the recording sheet from said recording sheet storing portion is interrupted and then re-tried in a predetermined case; and judge means for judging whether or not a recording sheet which is to be re-tried to be supplied by said recording sheet supplying member would overlap an inverted recording sheet re-fed by said recording sheet re-feeding member, wherein said controller corrects a re-try timing at which the supplying of the recording sheet is re-tried, based on a judged result of said judge means, so that the recording sheet being retried to be supplied by said recording sheet supplying member does not overlap the inverted recording sheet re-fed by said recording sheet re-feeding member.

2. The image forming apparatus as recited in claim 1, wherein judging whether or not the recording sheet re-tried to be supplied by said recording sheet supplying member overlaps the inverted recording sheet re-fed by said recording sheet re-feeding member is based on a comparison of a time expected for the re-tried recording sheet to reach a predetermined position and a time expected for the inverted recording sheet to reach said predetermined position.

3. The image forming apparatus as recited in claim 1, wherein said controller delays the re-try timing.

4. The image forming apparatus as recited in claim 1, further comprising re-try-permit means for permitting a re-trying of the supplying of the recording sheet when the recording sheet being re-tried to be supplied would not overlap the inverted recording sheet, wherein said controller controls said recording sheet supplying member to start re-trying the supplying of the recording sheet when said re-try-permit means permits.

5. An image forming apparatus, comprising:

an image holding member on which an image is formed;

a recording sheet transporting member which transports a recording sheet, onto which an image formed on said image holding member is transferred, to a transferring position while holding the recording sheet thereon, said transporting member being endless;

a recording sheet re-feeding member which inverts the recording sheet transported from said recording sheet transporting member and re-feeds the inverted recording sheet to said recording sheet transporting member to thereby allow transferring images on both sides of the recording sheet;

a recording sheet detector which detects positions of the recording sheets on said recording sheet transporting member and said recording sheet re-feeding member;

a recording sheet supplying member which supplies the recording sheet from a recording sheet supplying cassette;

a supply-time measuring means for measuring a time required for supplying the recording sheet from said recording sheet supplying cassette to a predetermined position;

a controller which controls said recording sheet supplying member so that a supplying of the recording sheet from said recording sheet supplying cassette is interrupted when the recording sheet would not travel to said predetermined position within a predetermined time period after said recording sheet supplying member starts supplying the recording sheet, and so that thereafter the supplying the recording sheet is re-tried;

judge means for judging whether or not a recording sheet which is to be re-tried to be supplied by said recording sheet supplying member would overlap the inverted recording sheet re-fed by said recording sheet re-feeding member, based on a detected result of said recording sheet detector;

wherein said controller corrects a re-try timing at which the supplying of the recording sheet is re-tried based on a judged result of said judge means so that the recording sheet re-tried to be supplied by said recording sheet supplying member does not overlap the inverted recording sheet re-fed by said recording sheet re-feeding member.

6. An image forming apparatus, comprising:

a recording sheet transporting member which has a specific portion and transports a recording sheet while holding the recording sheet thereon, said recording sheet transporting member being endless;

a recording sheet supplying member which supplies the recording sheet from a recording sheet storing portion toward said recording sheet transporting member;

a controller which controls said recording sheet supplying member so that a supplying of the recording sheet from said recording sheet storing portion is interrupted and then re-tried in a predetermined case; and judge means for judging whether or not a recording sheet which is to be re-tried to be supplied by said recording sheet supplying member would overlap said specific portion;

wherein said controller controls a re-try timing at which the supplying of the recording sheet is re-tried based on a judged result of said judge means so that the recording sheet re-tried to be supplied does not overlap said specific portion.

7. The image forming apparatus as recited in claim 6, wherein said specific portion is a seam.

8. The image forming apparatus as recited in claim 6, wherein judging whether or not the recording sheet re-tried to be supplied by said recording sheet supplying member overlaps said specific portion is based on a comparison of a time expected for the re-tried recording sheet to reach a predetermined position and a time expected for the inverted recording sheet to reach said predetermined position.

9. The image forming apparatus as recited in claim 6, wherein said controller delays the re-try timing.

10. The image forming apparatus as recited in claim 6, further comprising re-try-permit means for permitting a re-trying of the supplying of the recording sheet when the recording sheet being re-tried to be supplied would not overlap said specific portion, wherein said controller controls said recording sheet supplying member to start re-trying the supplying of the recording sheet when said re-try-permit means permits.

11. An image forming apparatus, comprising:

an image holding member on which an image is formed;

a recording sheet transporting member which has a seam and transports a recording sheet, onto which an image formed on said image holding member is transferred, to a transferring position while holding the recording sheet thereon, said transporting member being endless;

a seam detector which detects the seam;

a recording sheet supplying member which supplies the recording sheet from a recording sheet supplying cassette;

supply-time measuring means for measuring a time required to supply the recording sheet from the recording sheet supplying cassette to a predetermined position;

a controller which controls said recording sheet supplying member so that a supplying of the recording sheet from the recording sheet supplying cassette is interrupted when the recording sheet would not travel to said predetermined position within a predetermined time period after said recording sheet supplying member starts supplying the recording sheet, and so that thereafter the supplying the recording sheet is re-tried; and judge means for judging whether or not the recording sheet which is to be re-tried to be supplied by said recording sheet supplying member would overlap said seam based on a detected result of said seam detector;

wherein said controller corrects a re-try timing at which the supplying of the recording sheet is re-tried, based on a judged result of said judge means so that the recording sheet re-tried to be supplied by said recording sheet supplying member does not overlap said seam.

* * * * *